United States Patent [19]

Dunand et al.

[11] Patent Number: 4,907,816

[45] Date of Patent: Mar. 13, 1990

[54] APPARATUS FOR ATTACHING ONE END OF A SKI BOOT HAVING AN ATTACHING ELEMENT TO A SKI

[75] Inventors: Josiane Dunand, Cran Gevrier; Paul Arnulf, Alby S/Cheran; Denis Gasquet, Annecy, all of France

[73] Assignee: Salomon S.A., Annecy Cedex, France

[21] Appl. No.: 188,669

[22] Filed: Apr. 29, 1988

Related U.S. Application Data

[63] Continuation of Ser. No. 829,185, Feb. 14, 1986, abandoned.

[30] Foreign Application Priority Data

Mar. 5, 1985 [EP] European Pat. Off. ..... 85400412.2

[51] Int. Cl.[4] ..... A63C 9/20

[52] U.S. Cl. ..... 280/615

[58] Field of Search ..... 280/615, 614, 631, 632

[56] References Cited

U.S. PATENT DOCUMENTS

| | | | |
|---|---|---|---|
| 2,072,477 | 3/1937 | Dodd | 280/614 |
| 2,682,415 | 6/1954 | With . | |
| 3,920,257 | 11/1975 | Fredriksen | 280/615 |
| 3,979,132 | 9/1976 | Iser-Iser | 280/614 |
| 4,049,291 | 9/1977 | Nunan | 280/614 |
| 4,109,932 | 8/1978 | With . | |
| 4,166,637 | 9/1979 | Salomon | 280/625 |
| 4,239,257 | 12/1980 | Biermann et al. | 280/615 |
| 4,266,805 | 5/1981 | Weigl | 280/615 |
| 4,270,769 | 6/1981 | Berlied | 280/615 |
| 4,309,833 | 1/1982 | Salomon et al. | 280/615 |
| 4,382,611 | 5/1983 | Salomon | 280/615 |
| 4,438,947 | 3/1984 | Cooper | 280/615 |
| 4,484,762 | 11/1984 | Salomon | 280/615 |
| 4,496,169 | 1/1985 | Salomon et al. | 280/615 |
| 4,647,064 | 3/1987 | Salomon et al. | 280/615 |

FOREIGN PATENT DOCUMENTS

| | | | |
|---|---|---|---|
| 0171853 | 7/1952 | Austria | 280/632 |
| 0072766 | 2/1983 | European Pat. Off. | 280/615 |
| 0807789 | 7/1949 | Fed. Rep. of Germany | 280/615 |
| 2714990 | 10/1977 | Fed. Rep. of Germany | 280/615 |
| 2715907 | 10/1977 | Fed. Rep. of Germany | 280/615 |
| 2651562 | 5/1978 | Fed. Rep. of Germany | 280/631 |
| 2707626 | 8/1978 | Fed. Rep. of Germany | 280/615 |
| 1032305 | 2/1951 | France | 280/615 |
| 2355532 | 1/1978 | France | 280/631 |
| 2439602 | 5/1980 | France | 280/615 |
| 2447731 | 8/1980 | France | 280/615 |
| 2497674 | 7/1982 | France | 280/615 |
| 2527081 | 11/1983 | France | 280/615 |

*Primary Examiner*—David M. Mitchell

*Attorney, Agent, or Firm*—Sandler & Greenblum

[57] ABSTRACT

An apparatus for attaching one end of a boot to a ski. The apparatus includes a support, a movable lock, and a journal. The support is attached to the ski and is adapted to engage the boot. The movable lock pivots around the journal between an inactive, non-retention position in which the boot is free to be attached to and removed from the ski, and an active, retention position in which the boot is locked on the ski. The journal is positioned between the walls of a housing of the apparatus. The journal is spaced from these walls of the housing so as to produce play between the journal and the housing in response to the movable lock pivoting into its active, retention position.

56 Claims, 8 Drawing Sheets

Fig. 3
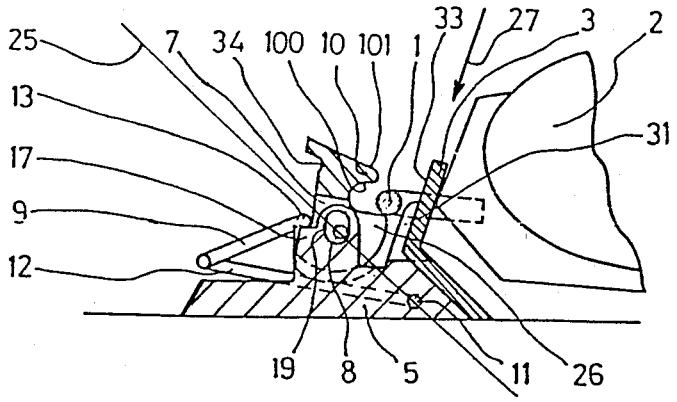
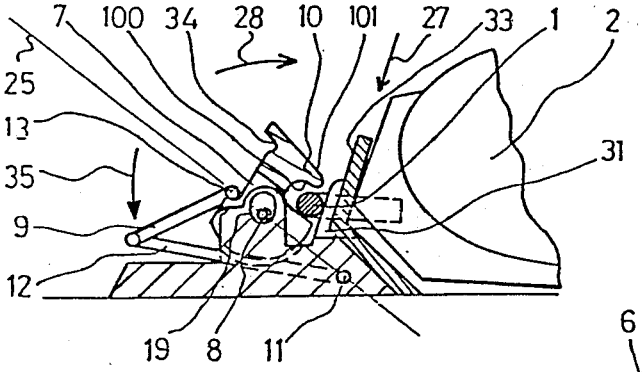
Fig. 4
Fig. 5
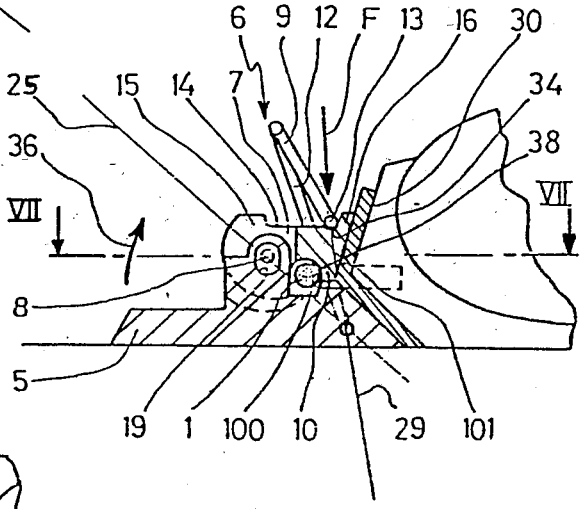
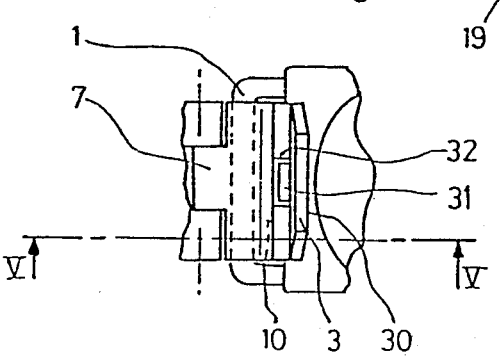
Fig. 6

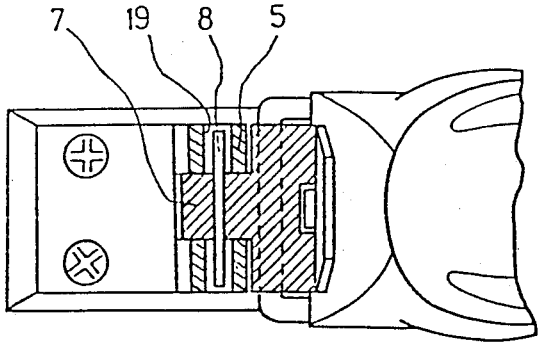
Fig. 7
Fig. 8
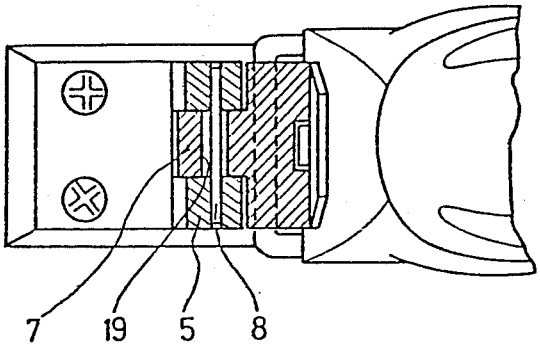
Fig. 12
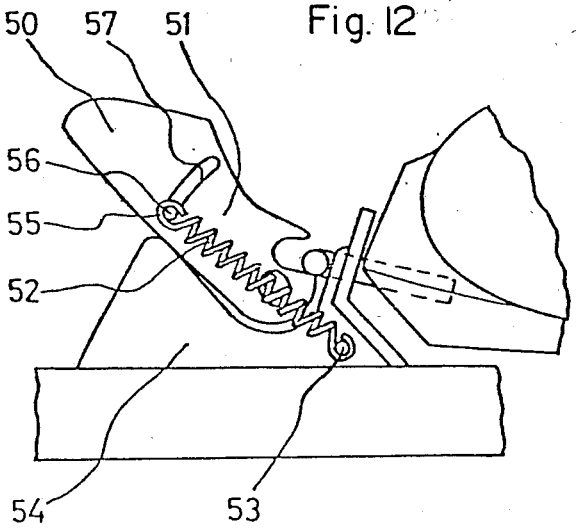

Fig. 9
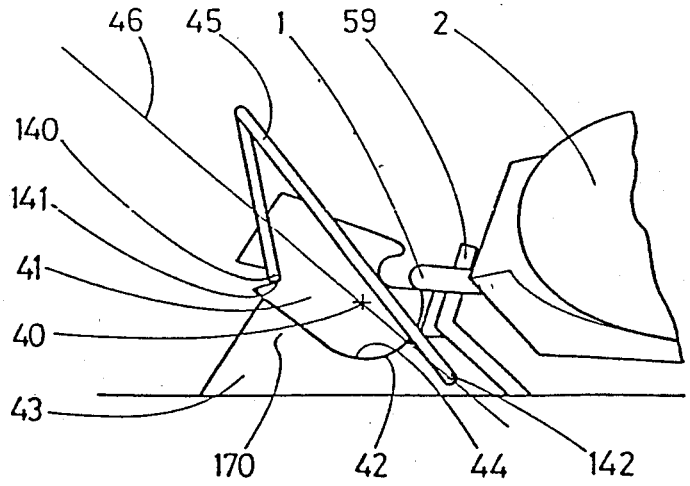
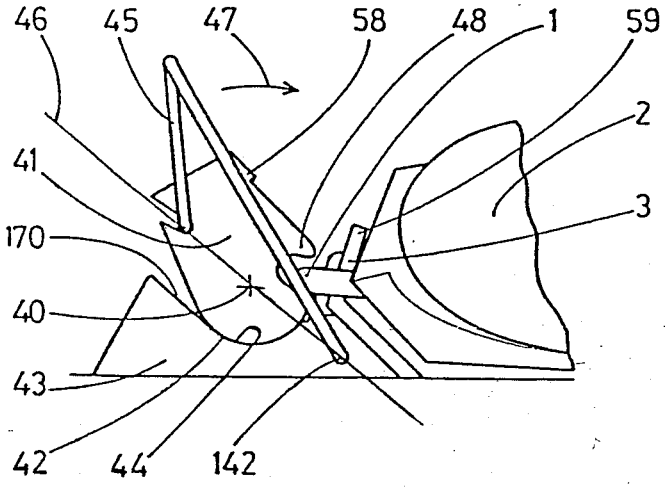
Fig. 10
Fig. 11
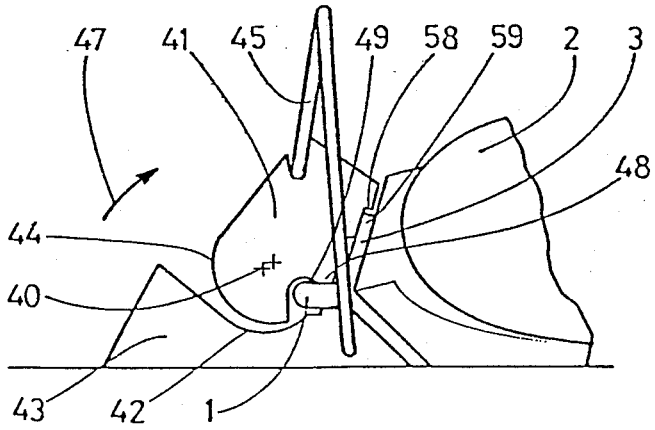

Fig. 13
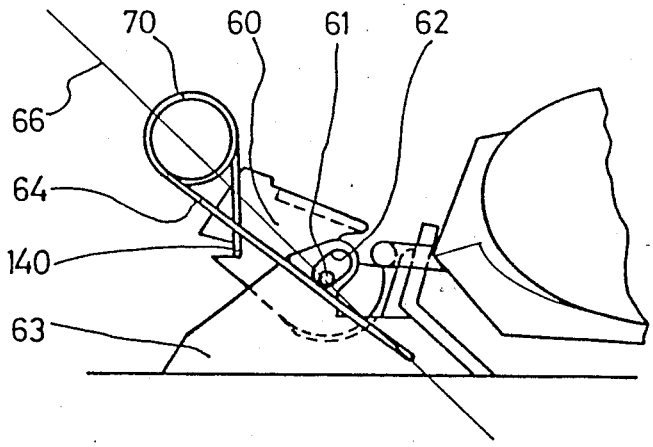
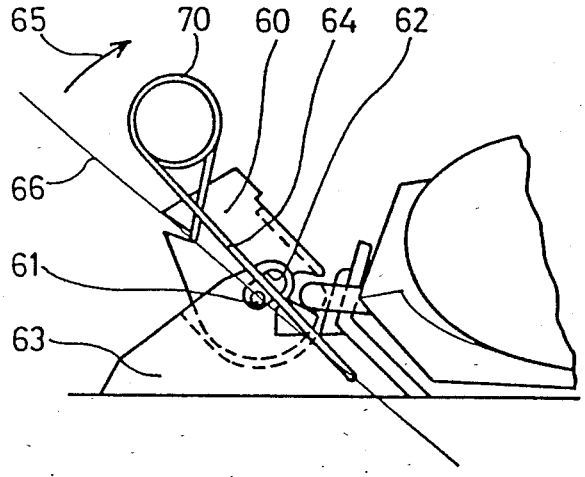
Fig. 14
Fig. 15
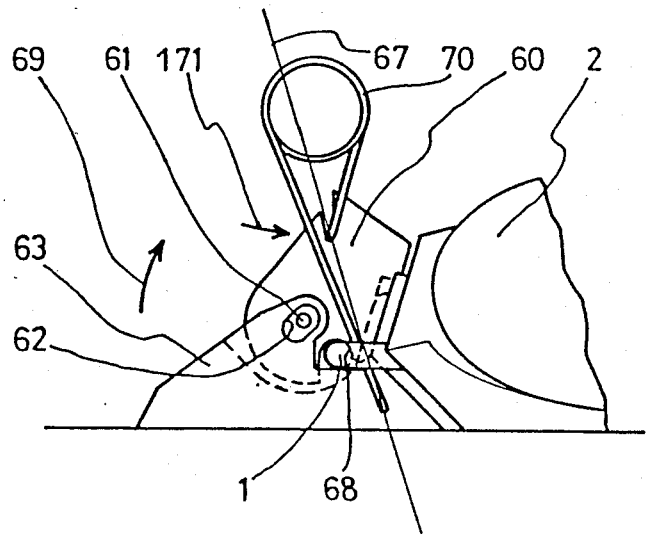

APPARATUS FOR ATTACHING ONE END OF A SKI BOOT HAVING AN ATTACHING ELEMENT TO A SKI

This application is a continuation, of application Ser. No. 829,185, filed Feb. 14, 1986 now abandoned.

BACKGROUND OF THE INVENTION

1. Related Applications

Reference is made to U.S. Pat. No. 4,382,611, entitled SKI BINDING AND BOOT, and U.S. application Ser. No. 337,824, filed Jan. 7, 1982, now U.S. Pat. No. 4.496,168 the disclosures of which are hereby incorporated by reference.

2. Field of the Invention

The present application relates to a ski binding for securing a boot to a ski.

Although the apparatus of the present invention can be used to secure either the front and/or the rear of the boot to a ski when practicing downhill skiing, it is more particularly adapted in the context of the present invention as a binding for securing the front end of the ski shoe or boot so that the heel is free to lift off the ski, as occurs in mountaineering or cross-country type skiing.

3. Description of Pertinent Information

Numerous bindings are known in which the attaching of the boot on the ski and the removing of the boot from the ski are done manually by a voluntary action of the skier on a journalled lever. For example, nordic-type bindings have been developed which have a pivoting stirrup that must be manipulated by hand. This type of arrangement is relatively old and well known and therefore, need not be further discussed. More recently, French Patent No. 2,447,731 of the Assignee of the present invention uses a manual manipulation means comprising a mobile lock biased by an elastic element. Although, these two bindings respond to the technical demands of cross-country skiing, specifically by retaining the sole of the boot on the ski, these bindings have the disadvantage of requiring manual manipulation by the skier. The required manipulations are annoying because the skier must bend forward, thereby effecting a considerable flexion and risking a loss of balance. It may even be necessary for the skier to place a knee on the ground which is often uncomfortable depending upon the quality Of the snow and/or the terrain. Further, when using bindings having a pivoting lock on a journalled mounting, not only is it necessary to disengage the lock before attaching the boot to the binding, which is equally true in the nordic-type bindings, but it is also necessary to return the lock to the corresponding part of the sole.

Other bindings, such as those described in the French Certificate of Addition No. 2,497,674 and in French Patent No. 2,527,081 are designed to remedy these disadvantages of manual manipulation by permitting one to attach the boot to the binding automatically. However, in order to allow for this automatic attachment of the boot to the ski in a manner compatible with known kinematics, it was necessary to very substantially reduce the force with which the boot is held on the ski below that which is normally obtained using bindings allowing the manual attachment of the boot on the ski. Further, these automatic bindings do not benefit from a large enough lever arm between the sole and the pivoting axis of the lock. In addition, because the lock of such automatic bindings pivots around a journal, the force which is exerted by the elastic system on the lock is distributed on the sole of the boot and the journal.

Thus, there is a need for a binding which permits the boot to be automatically attached and held on the ski with a force comparable to manual bindings and which does not transfer the retention force of the elastic system to the journal when the lock is in its active, retention position.

SUMMARY OF THE INVENTION

It is an object of the present invention to provide a simple and efficient binding that overcomes the above-discussed disadvantages by permitting the boot to be attached to the ski with relatively little effort on the part of the skier, while at the same time holding the boot on the ski with a large retention force.

In one embodiment, the invention relates to an apparatus for attaching or connecting one end of a boot to a ski. The apparatus comprises a support, a movable lock, and a means for pivotally attaching or means for connecting the movable lock the ski. The support engages the boot, and the movable locks the boot on the ski. The movable lock is adapted to pivot with respect to the ski between an inactive, non-retention position in which the boot is free to be attached to and removed from the ski and an active, retention position in which the boot is locked on the ski. The attaching means pivotally attaches the movable lock on the ski so as to permit the movable lock to pivot between its active, retention position and its inactive, non-retention position. Further, the attaching means is positioned between the walls of a housing of the apparatus. The attaching means is spaced from these walls of the housing so as to produce play between the attaching means and the housing when the movable lock is in its active retention position.

The boot which is adapted to be used with such an apparatus can comprise an end and an attaching element at this end of the boot. The present invention which is designed to be used with such a boot includes a support adapted to engage either the end of the boot and/or the attaching element at the end of the boot. In addition, the attaching means pivotally attaches the movable lock to the ski around an axis transverse to the ski so that the movable lock is adapted to pivot around the transverse axis between its active, retention position and its inactive, non-retention position.

The connecting means of the apparatus pivots about an axis and is spaced from the walls so as to produce play in all directions about the axis.

The apparatus further comprises means for elastically biasing the movable lock against displacement out of its active, retention position.

In one embodiment in which the support is attached to the ski, the attaching means is integral with the support and the housing is positioned in the movable lock. In an alternative embodiment in which the support is attached to the ski, the attaching means is integral with the movable lock and the housing is positioned in the support. In still another embodiment in which the support is attached to the ski, the support includes an upper surface having a groove thereon. This groove has a substantially semi-circular cross-section. The movable lock also comprises a portion having a substantially semi-circular cross-section which corresponds to the substantially semi-circular groove and which pivots in the groove. The attaching means in this embodiment comprises the movable lock itself, and the housing comprises the groove.

The attaching means contacts at least one of the walls of housing in response to the movable lock being pivoted into its inactive, non-retention position. In addition, the movable lock and the elastic means can comprise means for biasing one end of the boot and the attaching element against the support. Further, the elastic biasing means biases the lock against displacement out of its inactive, non-retention position In one embodiment, the elastic biasing means can comprise a spring pivotally mounted on the support between first and the second positions. In the first position the spring biases movable lock against displacement out of the active, retention position, and in its second position the spring biases the movable lock against displacement out of its inactive, non-retention position.

In another embodiment, the elastic biasing means is pivotably attached to the ski around an axis transverse to said ski. In this embodiment the elastic biasing means biases said movable lock at an activation point on the movable lock. Further, the attaching means, the elastic biasing means, and the movable lock together comprise a toggle system defined by the relative positions of the transverse axis around which the movable lock pivots, the transverse axis around which the elastic biasing means pivots and the activation point.

The toggle system comprises means for biasing the movable lock into its active, retention position when activation point is positioned on one side of a plane passing through the transverse pivot axis of the elastic biasing means and the transverse pivot axis of the movable lock. The toggle system also comprises means for biasing the movable lock into its inactive, non-retention position when the activation point is positioned on the other side of this plane. Further, the activation point of the elastic biasing means on the movable lock is displaced in response to pivoting of the elastic biasing means around its transverse axis. Also, the toggle system comprises means for displacing this activation point into the plane passing through the transverse axis of the movable lock and the transverse axis of the elastic biasing means in response to pivoting the movable lock away from its inactive, non-retention position to an unstable, intermediate position intermediate between its inactive, non-retention position and its active, retention position without relative movement of the activation point and the movable lock. Further, the activation point is displaced out of this plane with respect to the movable lock in response to pivoting the movable lock from its intermediate position toward its active, retention position. Also, the elastic biasing means may comprise a spring having two lateral portions and a median portion connecting the two lateral portions. In this embodiment each lateral portion comprises an end and each of these ends of the lateral portions of the spring are pivotably attached to one of the lateral sides of the support. Further, the median portion of the spring contacts the movable lock at the activation point.

The apparatus further comprises first and second abutments for limiting the pivoting of the movable lock. The first abutment defines the active, retention position of the movable lock and the second abutment defines inactive, non-retention position of the movable lock. Further, the movable lock is in its active, retention position when the movable lock contacts the first abutment, and the movable lock is in its inactive, non-retention position when the movable lock contacts the second abutment. The second abutment is positioned on one side of a plane passing through the transverse axis of the movable lock and the transverse axis of the elastic biasing means. Also, the second abutment defines a stable, inactive, non-retention position of the movable lock.

The movable lock can also comprise a ramp, on which the activation point is positioned. The elastic biasing means engages this ramp at the activation point. The ramp comprises first and second abutments. The elastic biasing means contacts the first ramp abutment in response to pivoting the movable lock into its active, retention position, and the elastic biasing means contacts the second ramp abutment in response to pivoting of the movable lock into its inactive, non-retention position. Further, the ramp comprises two ends, at which one of the ramp abutments are each positioned. In this embodiment, the first and second ramp abutments each prevent movement of the elastic biasing means in a different direction when the elastic biasing means contacts the first and second ramp abutments. Also, the ramp comprises a retention notch for retaining said elastic biasing means therein. This retention notch comprises the activation point of the elastic biasing means on the movable lock when the lock is in its active, retention position. Further, the apparatus comprises means for positioning the movable lock in a stable, active, retention position and means for positioning the movable lock in a stable, inactive, retention position.

The movable lock can further comprise a lower ridge comprising a pedal adapted to cooperate with at least one of the following during the attachment of the boot to the ski: the boot and the attaching element of the boot. The apparatus further comprises means for pivoting the movable lock from its inactive, non-retention position to its active, retention position in response to downward pressure from either the boot or the attaching element of the boot on the pedal. As a result, the apparatus comprises means for automatically attaching the boot on the ski.

The movable lock can further comprise a pressure nose adapted to contact the support when the movable lock is in its active, retention position. In this embodiment, the attaching element can comprise a transverse bit having two lateral arms and a transverse arm connecting the two lateral arms. The transverse arm comprises a rear side having a support point thereon. Also, the pressure nose comprises a front side and a rear side. In this embodiment the apparatus further comprises means for engaging the front side of the pressure nose with the rear side and the support point of the transverse arm as the movable lock pivots into its active, retention position. In addition, the apparatus further comprises: means for engaging the attaching means with the walls of the housing when the movable lock is in its inactive, non-retention position; means for displacing the attaching means out of contact with these walls before the movable lock pivots into its active, retention position; means for engaging the front side of the pressure nose with the support point of the transverse arm before the movable lock pivots into its active retention position; and means for pivoting the movable lock on the support point as the attaching means is displaced out of contact with the walls of the housing.

In addition, the pressure nose is adapted to engage the attaching element and the support. In one embodiment, the pressure nose engages the attaching element and the support in response to pivoting of the movable lock into its active, retention position. In still another embodiment, the boot which is used with the present invention comprises a front end. In addition, the support element, the attaching means, and the pressure nose comprise a front and a rear surface. In this embodiment, the apparatus further comprises means for: biasing the front end of the boot against the rear surface of the support; biasing the rear surface of the pressure nose against the front surface of the support; and biasing the front surface of the pressure nose against the rear surface of the attaching means, all in response to pivoting of the movable lock into its active, retention position.

In still another embodiment, the pressure nose comprises first and second transversely extending sides The first side of the pressure nose engages the support in response to the pivoting of the movable lock into its active, retention position The second side of the pressure nose engages the attaching element in response to pivoting the movable lock into its active, retention position. The pressure nose is substantially V-shaped when viewed from a direction transverse to the ski, and the pressure nose can also extend transversely to the ski. Further, the force exerted on the movable lock by the elastic biasing means can be along a direction passing through the pressure nose.

A boot which is designed to be used with the binding of the present invention comprises a support zone thereon. Also, the support of the present invention can comprise a first side facing the boot, and a second side opposite from the first side. This second side comprises a median portion and the support can extend vertically above the ski. The first side of the support comprises an abutment zone adapted to engage the support zone of the boot when the movable lock is in its active, retention position. The second side of the support comprises a boss positioned in the median portion of the second side. Also, the pedal comprises a groove, corresponding in shape to the boss, so that the groove of the pedal is adapted to engage the boss when the movable lock is in its active, retention position. Further, the boss can be positioned on the second side at substantially the height of the pedal when the movable lock is in its inactive, non-retention position. The boot is attached to the ski by raising the boot above the apparatus, lowering the boot so that the attaching element of the boot slides down the second side of the support and then slides over the boss, thereby forcing the boot forward toward the abutment zone of the support, continuing to displace the attaching element downward until the attaching element contacts the pedal, and pressing the pedal downward with the attaching element, thereby rotating the movable lock from its inactive, non-retention position toward its active, retention position.

In one embodiment, the elastic biasing means comprises a spring having two lateral arms, each of which is attached to the support, and a median portion connecting the two lateral arms. The median portion is adapted to be displaced on the movable lock. Also, the elastic biasing means is pivotally attached to the ski at the two lateral arms around an axis transverse to the ski. Further, the elastic biasing means biases the movable lock at an activation point on the movable lock. In this embodiment, the attaching means, the elastic biasing means, and the movable lock together comprise a toggle system defined by the relative positions of the transverse axis around which the movable lock pivots, the transverse axis around which the elastic biasing means pivots, and the activation point. Further, the elastic biasing means comprises means for displacing the movable lock from its active, retention position to its inactive, non-retention position and from its inactive, non-retention position to its active, retention position by pivoting the elastic biasing means across a plane passing through the transverse axis of the movable lock and the transverse axis of the elastic biasing means.

The elastic biasing means is adapted to pivot on the ski around a transverse axis. Further, the elastic biasing means can comprise a median portion adapted to slide on a surface of the movable lock in response to pivoting of the elastic biasing means. In addition, the movable lock can comprise an abutment for limiting the displacement of the median portion of the elastic biasing means on the surface of the movable lock. This abutment is positioned in front of the plane passing through the transverse axes of the movable lock and the elastic biasing means. In addition, the apparatus in this embodiment can further comprise means for changing the position of the abutment.

The elastic biasing means can also comprise a stirrup comprising a metallic, elastic, deformable wire having two ends and a median portion between the two ends. The two ends define a pivoting axis around which the wire is adapted to pivot, and the two ends are elastically connected to the median portion. In one embodiment, the wire can comprise a lever comprising means for manually removing the boot from the ski when the boot is held on the ski by the movable lock.

In another embodiment, the movable lock further comprises a ramp and a movable element adapted to be displaced on the ramp. In this embodiment, the elastic biasing means comprises a traction spring having first and second ends. The first end is attached to the support, and the second end is attached to the movable element. Further, the support is attached to the ski, and the support comprises an upper surface having a groove thereon. The groove has substantially semi-circular cross-section. In this embodiment, the movable lock comprises a portion having a substantially substantially semi-circular cross-section which corresponds to the semi-circular groove and which pivots in the groove. Further, the movable lock comprises the attaching means, and the groove comprises the housing.

The apparatus can further comprise means for applying the force of the elastic biasing means on the movable lock behind the point of contact between the attaching element and the movable lock when the movable lock is in its active, retention position.

In still another embodiment, the support is attached to the ski and comprises an upper surface having a groove thereon and an opening therein comprising the housing for housing the attaching means. This groove has a substantially semi-circular cross-section, and the movable lock comprises a portion having a substantially semi-circular cross-section which corresponds to the substantially semi-circular cross-section which engages the groove as the movable lock pivots around the attaching means.

The elastic biasing means can also comprise an elastically deformable element having two lateral arms each attached to the support and a median portion between the lateral arms. The median portion can comprise an elastically deformable coil extending above the movable lock.

In still another embodiment, the apparatus further comprises means for producing a stable, active, retention position for the movable lock, and for producing an unstable, inactive, non-retention position for the movable lock.

In still another embodiment, the support is attached to the ski and comprises a stirrup having two lateral wings, each of which comprises a tenon. In this embodiment, the attaching means comprises two spaced apart lateral mortises. The boot is attached to the ski by raising the boot above the ski and over the lateral wings, and displacing the boot downward so that each tenon engages one of the mortises. In this embodiment, the movable lock further can comprise a pressure nose at the rear end thereof. Further, the attaching element can comprise a front portion having a profile complementary to the shape of the pressure nose so that the pressure nose engages the profile when the movable lock is in its active, retention position. Further, the apparatus in this embodiment can comprise means for producing a stable, active, retention position for the movable lock and for producing an unstable, inactive, non-retention position for the movable lock.

In still another embodiment, the apparatus can comprise a cross-country ski binding which is adapted to be used with a boot having a heel. The cross-country ski binding attaches the boot to the ski so that the heel of the boot is permitted to be lifted off of the ski. In one embodiment, the support is rigidly affixed to the ski, and the support comprises a bottom surface attached to the ski so that the entire bottom surface of the support remains rigidly affix to the ski in response to lifting the heel of the boot upward. In an alternative embodiment, the apparatus further comprises a base plate, rigidly attached to the ski. The support is pivotally attached to the base plate around an axis transverse to the ski, so that the lifting of the heel of the boot pivots the support upwardly around the transverse axis of the base plate. This embodiment may also be provided with means for pivotally linking the base plate and the support. In this embodiment, the linking means comprises means for elastically biasing the boot downwardly toward the ski. In still another embodiment, the support comprises a first portion rigidly attached to the ski and a second portion attached to the boot. In this embodiment. the support is flexible between the first and second portions so that the lifting of the boot above the ski flexes and lifts a portion of the support above the ski. In still another alternative embodiment, the apparatus may further comprise means for limiting the lifting of the heel off the ski.

In another embodiment, the apparatus comprises the invention described above in combination with the attaching element and/or the boot. In still another embodiment, the lock comprises two wings, each comprising a mortise, and the support comprises two tenons, each adapted to be received in one of the mortises.

In still another embodiment the invention relates to a binding that holds a boot on a ski with a strong force due to the total lack of contact between the means for pivoting the lock and the lock when the lock is in its active, retention position for retaining the boot on the ski, thereby ensuring that the elastic system acts only on a pressure nose of the lock. In one embodiment the apparatus holds one end of a ski boot to a ski, and the boot that is used with the apparatus comprises an attaching portion.

The apparatus comprises a support adapted to receive and cooperate with the end of the boot or with an attaching portion of the boot. The apparatus also includes a movable lock pivotally attached to the ski around a transverse pivoting axis. The lock is adapted to pivot between an inactive, non-retention position in which the boot is not retained on the ski and an active, retention position for retaining the boot on the ski and in which the lock is biased by an elastic system. In its active retention position, the pivoting axis is spaced, on all sides, from the walls of its housing so as to produce a play "e" between the axis and the housing.

According to one embodiment of the invention, the present invention is applied to a binding of the type described earlier, which is to be used with a boot having an attaching portion. The invention comprises: a support element or stirrup linked to the ski and adapted to receive the attaching portion of the boot; an elastic locking apparatus designed to retain the attaching portion on the support; and a retention support ensuring the linkage of the apparatus to the ski. In a known manner the elastic locking apparatus comprises a lock which pivots between a position in which the boot is held on the ski and a position in which the boot can be removed from the ski. An elastic system is associated with the lock and pivots with the lock in such a manner that the action of the elastic system (which can comprise an elastic element or spring) biases the lock into two extreme position (i.e. its active and inactive positions). According to the invention, the lock pivots around an axis and a journal through which the axis passes, and on which the look pivots and upon which the lock rests during its displacements between its inactive and active positions. When the lock is in its active position, the lock rests only on a resting point on the attaching portion of the boot and the support element. As a result, the pivoting axis and the journal float. According to a first embodiment, the axis and the journal are integral with the lock and the retention support has a housing therein, which is larger than the journal and which is adapted to receive the axis and the journal. According to a second embodiment of the apparatus, the pivoting axis and the journal are integral with the support and the lock comprises a housing which is larger than the journal and through which the axis passes, and which is adapted to receive the journal.

According to the third embodiment of the invention, the pivoting axis of the lock and the journal are positioned in a semi-circular housing on the support. A profiled portion of the lock engages the housing. Preferably, this portion of the lock has a profile corresponding to that of the housing. When the lock is in its active position, the elastic system biases the lock on the attaching portion of the boot by provoking the pivoting of the lock around the point on which the lock rests on the attaching portion of the boot until the lock rests against a support point on the attaching portion of the boot, thereby moving out of contact with the semi-circular housing of the support.

According to another embodiment the lock is adapted to be positioned in stable active and inactive positions. In the embodiment in which the lock has a stable inactive position the lock is preferably equipped with a maneuverable pedal adapted to engage the attaching portion of the boot when the boot is placed on the ski.

According to still another embodiment, the locking apparatus is displaceable between its active and inactive positions by means of an elastic element comprising at least one prehensile portion.

Finally, depending upon the desired freedom of movement of the end of the boot with respect to the ski, the support of the retention apparatus or binding can be equipped with a flexion zone or can be pivotably attached to the ski around a rotation axis, and can include at least one abutment designed to limit the degree of displacement of the ski boot.

BRIEF DESCRIPTION OF THE DRAWINGS

The invention will be better understood upon referring to the detailed description which follows with reference to the attached drawings illustrating by way example, several embodiments of the apparatus, in which:

FIGS. 1–7 represent a first embodiment of the present invention;

FIGS. 1 and 2 are perspective views, in which FIG. 1 shows the present invention in its active, retention position, and FIG. 2 shows the same apparatus in an inactive, non-retention position;

FIGS. 3, 4, and 5 illustrate partial cross-sectional views of the apparatus, taken along line V—V of FIG. 6, showing the different phases of functioning of the present invention; more specifically FIG. 3 shows the apparatus of the present invention in its initial, inactive position which permits placement of the boot on the ski and removal of the boot from the ski; FIG. 4 shows the apparatus in an intermediate position between the active and inactive positions; and in FIG. 5 shows the apparatus in its active, retention position in which the boot is retained on the ski;

FIG. 6 illustrates a partial top view of the invention in its active, retention position;

FIG. 7 is a cross-sectional view taken along line VIII-VII of FIG. 5;

FIG. 8 is a view similar to FIG. 7 showing another embodiment of the present invention;

FIGS. 9, 10, and 11 show elevational views of the different phases of functioning of the apparatus in a second embodiment of the present invention;

FIG. 12 is an elevational view of another embodiment of the elastic system of the present invention;

FIGS. 13, 14 and 15 show elevational views of the different phases of the functioning of the apparatus of a third embodiment of the present inventions;

DETAILED DESCRIPTION OF PREFERRED EMBODIMENTS

Figure 1:
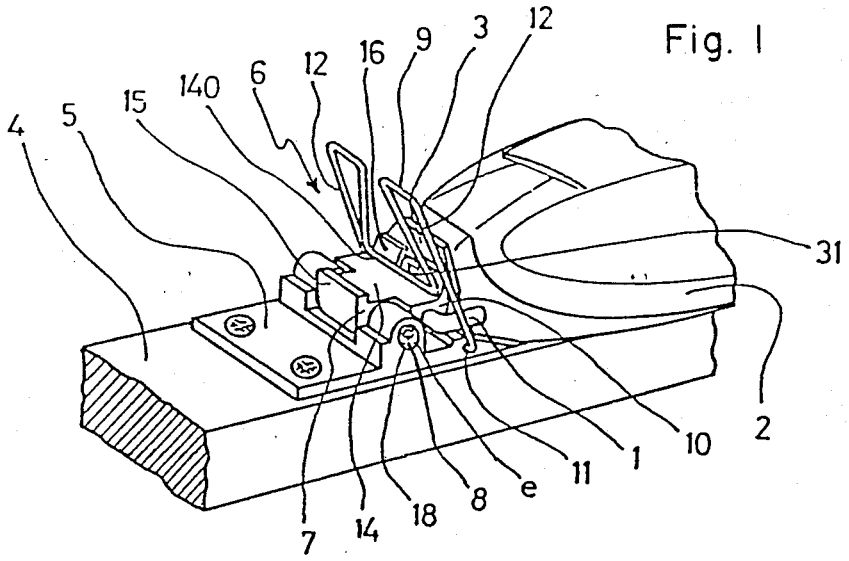

In the embodiment illustrated in FIGS. 1–7 the apparatus comprises an attaching element 1 integral with a boot 2. Element 1 comprises a transverse bit having two lateral arms and transverse portion connecting the two lateral arms. The apparatus further comprises a support element 3 attached to a ski 4 by means of a support 5. The apparatus further comprises a locking system 6 adapted to retain the attaching element 1 on support element 3 by means of a movable lock 7. Movable lock 7 is pivotally attached to support 5 by journal 8. Reference numeral 8 may also refer to the transverse axis around which lock 7 pivots and which passes through journal 8. Movable lock 7 is subjected to the action of an elastic element for elastically biasing lock 7 as will be described in detail below. In one embodiment, the elastic element can comprise a spring 9. Lock 7 is preferably provided with a pressure nose 10 which, under the bias of spring 9, exerts itself on attaching element 1 and against support element 3 as seen in FIG. 3, so as to function as a wedge.

Spring 9 comprises two lateral arms 12 connected by a median portion 13. Spring 9 is pivotally mounted on support 5 at the ends 11 of its lateral arm 12. Further, median portion 13 is pressed against an activation zone 14 of lock 7 at activation point 140. More precisely, in the embodiments illustrated in FIGS. 1–7, median portion 13 presses against activation zone 14 along a line extending along the length of median portion 13. This line comprises a plurality activation points. Because of the pivotable connection of spring 9 to support 5, median portion 13 of spring 5 can be displaced over the length of activation zone 14 as will be discussed below. Further, it will be explained below that the position of median portion 13 along the length of activation zone 14 determines the functioning of movable lock 7. Because median portion 13 extends transversely to the length of activation zone 14, each of the activation points of median position 13 are displaced to the same point along the length of activation zone 14 when median portion 13 is displaced along the length of activation zone 14. Further, because it is the point along the length of activation zone 14 that is important to the functioning of the present invention, when the present application refers to activation point 140, it will be understood that this means the point along the length of activation zone 14 at which median portion 13 contacts activation zone 14.

Figure 2:
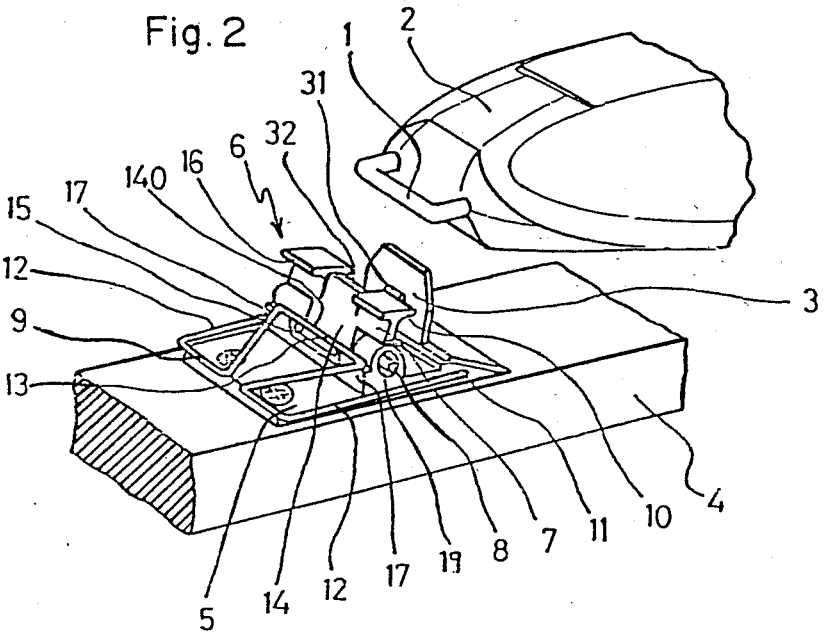

Journal 8 of lock 7 is situated between end 11 of spring 9 and activation zone 14. Therefore, depending upon whether the activation point 140 of spring 9 on lock 7 is positioned on one side of journal 8 as seen in FIG. 1, or on the other side of journal 8 as seen in FIG. 2, lock 7 is biased respectively, into either an active, retention position in which the boot is held and locked on the ski, or an inactive, non-retention position in which the boot is not held on the ski, but rather, is permitted to be removed from or placed on the ski. Further, ends 11 of spring 9, median portion 13 of spring 9, and journal 8 of lock 7 comprise three points of a toggle element formed by movable lock 7, spring 9, and journal 8 as will be explained below.

Lock 7 is also provided with bosses 15 and 16 which are positioned on lock 7 so as to comprise the outer limits of activation zone 14 of spring 9. Boss 16 prevents the displacement of median portion 13 rearwardly on zone 14 beyond boss 16, and boss 15 prevents the displacement of median portion 13 forwardly on zone 14 beyond boss 15. It should be noted as used in this application the term "forwardly", and "forward", refer to the normal direction of travel of the ski (to the left in FIGS. 3–5) and the terms "rearwardly" and "rear" refer to a direction opposite from "forewardly", and "forward". The extreme positions in which lock 7 can be placed, i.e., its active and inactive position, are determined, respectively, by support element 3, against which nose 10 is biased as seen in FIG. 1, and by abutments 17 provided on support 5, and upon which median portion 13 of spring 9 comes to rest.

In accordance with the present invention, journal 8 of lock 7 is mounted in a floating manner in a housing 19 positioned on support 5 in such a manner that journal 8 is spaced from the walls of housing 19 so as to produce a play "e" between journal 8 and the walls of housing 19. Therefore, journal 8 loses all support from housing 19 when lock 7 is in its active position in which pressure nose 10 engages attaching element 1 of the boot as seen in FIG. 1. Conversely, when lock 7 is displaced into its inactive, non-retention position in which the boot can be removed from the ski, journal 8 once again rests against the walls of housing 19 of the support, and pressure nose 10 of lock 7 moves out of contact with attaching element 1.

The functioning of the present invention will be better understood with reference to FIG. 3, 4, and 5. In FIG. 3, lock 7 is in a stable, inactive, non-retention position which permits removal of the boot from the ski and which permits the boot to be placed into engagement with the lock. Median portion 13 of spring 9 is positioned in front of a plane 25 passing through ends 11 of arms 12 of spring 9 and passing through the point at which journal 8 of lock 7 is supported in housing 19 of the support 5 (i.e. the support point of journal 8). As a result, median portion 13 is elastically biased to return to the plane of lateral arms 12, thereby biasing lock 7 against abutment 17 of support 5.

In order to permit the automatic attachment and locking of the boot on the ski, lock 7 is equipped with a pedal 26 adapted to pivot lock 7 from its inactive, non-retention seen in FIG. 3, to its active, retention position seen in FIG. 5 in response to downward pressure along the direction indicated by arrow 27 in FIGS. 3 and 4 of attaching element 1 on pedal 26 as element 1 moves downward on support element 3. In FIG. 4, attaching element 1 of boot 2 has provoked the pivoting of lock 7 in the direction indicated by arrow 28 into an intermediate position, and median portion 13 of spring 9 has been brought substantially into plane 25. In this intermediate position, lock 7 is in a unstable, balanced, equilibrium position, because the direction of the force exerted by spring 9 extends along the line connecting support points 11, 8, and 13 of the toggle system. By continuing to displace element 1 downward in the direction of arrow 27, median portion 13 crosses plane 25 (also called equilibrium threshold 25) and lock 7 then pivots into its active, retention position seen in FIG. 5 due to the elastic bias of median portion 13 of spring 9 which slides rearwardly on activation zone 14 and comes to rest against boss 16 so as to return closer to the plane defined by lateral arms 12 of spring 9. At the same time, a plane 29 passing through median portion 13 and ends 11, and the point at which the force F generated by spring 9 acts on activation zone 14, passes behind a point 38 at which a front side 100 of nose 10 is supported on element 1. As a result, lock 7 pivots around this support point 38 in the direction indicated by arrow 36, and journal 8 leaves its support in housing 19 of support 5, thereby moving out of contact with the walls of housing 19. Consequently, all of the force generated by elastic system 6 is brought to bear on nose 10 of lock 7 which, in the matter of a wedge, positions rear side 101 of nose 10 against a front surface 33 of support element 3, and positions front side 100 of nose 10 against element 1. Furthermore, an abutment zone 30 on the rear side of support element 3 is pressed against the front of the boot because attaching element 1 is pushed forward by nose 10, thereby pulling the front of the boot against abutment zone 30. Thus, attaching element 1 is attached to the ski and to support element 3.

In order to facilitate the engagement of pressure nose 10 between attaching element 1 and support element 3, a boss 31 is provided on the front end of support element 3, on the side opposite from abutment zone 30. Boss 31 preferably extends on the support element at least to substantially the height of pedal 26 when lock 7 is in its inactive, non-retention position seen in FIG. 3. Further, boss 31 is substantially centered on support element 3 at the median portion thereof. In order to accommodate boss 31, pressure nose 10 comprises a groove 32 adapted to permit passage of boss 31, which is visible in FIGS. 2 and 6. Thus, by engaging element 1 on support element 3, and by moving element 1 in the direction of arrow 27, element 1 first slides on surface 33 of support element 3, and then on boss 31, thereby forcing boot 2 to advance toward abutment zone 30. It should be noted that the thickness of boss 31 depends upon the thickness of groove 32 in nose 10.

Further, it should be noted that in the embodiment of the apparatus described above, median portion 13 of spring 9 can be displaced on activation zone 14 between bosses 15 and 16 of lock 7. This is important for the following reason. During the normal practice of skiing, the skier is likely to generate forces on the boot tending to release attaching element 1 of the boot from support element 3. These forces, which are opposed to those of spring 9, are elastically absorbed by spring 9, causing median portion 13 to slide on activation zone 14.

In order to eliminate the sensation of floating which could appear due to this elastic absorption, a notch 34, illustrated in FIGS. 3–5, is preferably provided at the base of boss 16. As a result, when median portion 13 of spring 9 is displaced sufficiently rearwardly on zone 14, portion 13 engages and stops in notch 34 at one extreme end of zone 14. This position of portion 13 is the active, retention position of spring 9 and median portion 13, which corresponds to the active, retention position of lock 7. Conversely, whenever median portion 13 is positioned against boss 15 as seen in FIG. 3, median portion 13 and spring 9 are in their active, non-retention position which corresponds to the inactive, non-retention position of lock 7.

To manipulate the apparatus to remove the boot from the ski, it is sufficient to use spring 9 itself as a lever by pushing it backward in the direction of arrow 35 seen in FIG. 4. When this occurs, median portion 13 will leave notch 34 and slide on activation zone 14 until portion 13 contacts boss 15. In crossing zone 14, spring 9 passes to the other side of (i.e., behind) support point 38 of the pressure nose 10, which causes lock 7 to pivot, thereby displacing journal 8 against one of the walls of housing 19. Second, by continuing to push spring 9 in the direction of arrow 35, lock 7 moves out of contact with support point 38 on attaching element 1, and pivots in the same direction as spring 9 until median portion 13 crosses equilibrium threshold 25. When median portion 13 crosses plane 25 to be displaced in front of plane 25, spring 9 partially slackens its bias on the lock until median portion 13 comes to rest on abutment 17 as seen in FIG. 3.

The functioning of the apparatus is based upon the principle of a toggle joint or apparatus. In addition, activation zone 14 of lock 7 is oriented with respect to ends 11 of spring 9 on support 5 in such a manner that spring 9 is placed under tension, which is important during the removal of the boot from the ski, and which is effected by manual means; the energy thus accumulated is partially used to slacken the spring when median portion 13 is displaced in front of equilibrium threshold 25 and comes to rest on abutments 17. Of course, abutments 17 can be of advantageously positioned as close as possible to equilibrium threshold 25 so that during the placing of the boot on the ski, the effort necessary to pivot lock 7 by moving element 1 downward along arrow 27 can be as small as necessary. To implement this effect, means can be provided for adjusting the position of abutments 17 as close as desired to threshold 25.

Figure 7A:
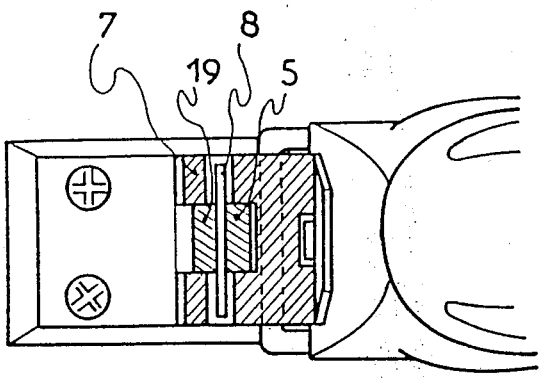
FIGS. 7*a* and 8*a* illustrate alternative embodiments of the invention illustrated in FIGS. 7 and 8.

In the first embodiment illustrated FIGS. 1–7, journal 8 of lock 7 is integral with lock 7, as seen in FIG. 7, while housing 19 is positioned on support 5. In a second embodiment illustrated in FIG. 8, journal 8 is integral with support 5, while housing 19 is positioned on lock 7.

It is within the scope of the invention for lock 7 to comprise two wings forming a mortise on the side of the pivoting portion of lock 7 on the support. Further, the support can comprise tenons which lodge themselves in the mortises. In this embodiment, the link between the lock and the support is accomplished as was done earlier by means of a journal 8 as seen in FIGS. 7 and 8.

Figure 8A:
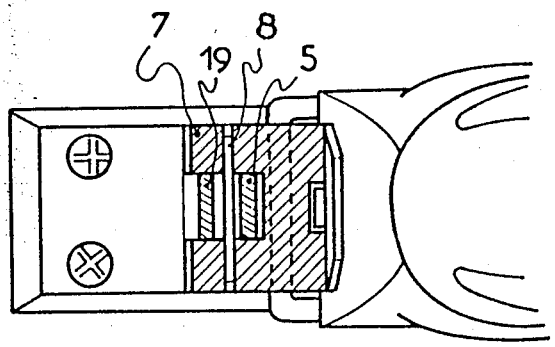
Figure 17A:
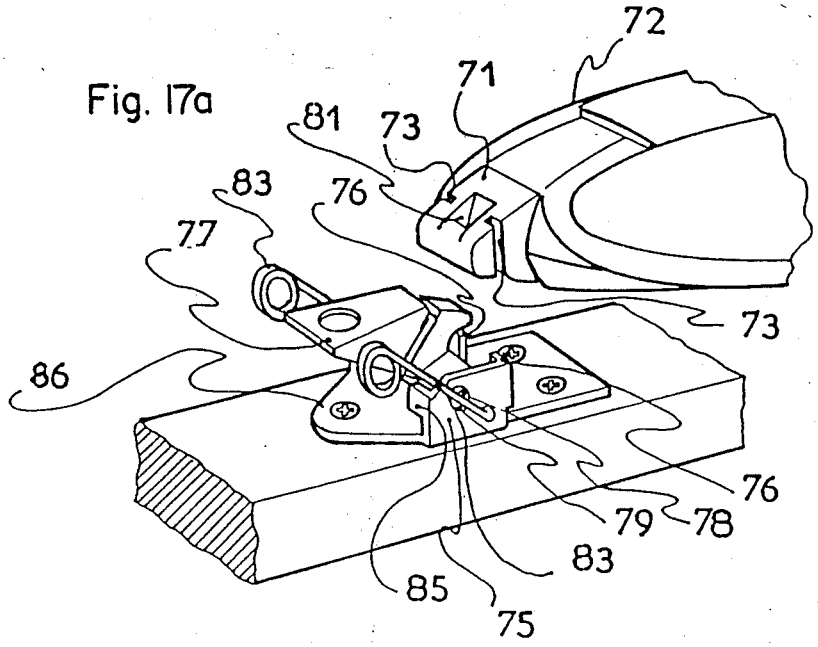
FIG. 17*a* illustrates a perspective view of the embodiment illustrated in FIGS. 16 and 17.

These alternative embodiments are illustrated in FIGS. 7 and 8, which correspond in all other respects to FIGS. 7 and 8.

According to a third embodiment illustrated in FIGS. 9–11, pivoting axis 40 of lock 41 is positioned in a semi-circular housing 42 provided on the top surface of support 43. A spring 45 biases a complimentary shaped portion of lock 41 having a profile 44 against the upper surface or wall of housing 42. Both profile 44 and housing 42 have a substantially semi-circular cross-section. A stable, inactive, non-retention and unlocked position of lock 41 is illustrated in FIG. 9 and is obtained by the use of abutment 170 provided on support 43, so that lock 41 comes to rest against abutment 170 under the effect of spring 45. The functioning of lock 41 is identical to that of the preceding embodiments; as soon as equilibrium threshold 46 is crossed by activation point 140 of the spring, which comes to rest in housing 141 seen in FIG. 10, lock 41 pivots along the direction of arrow 47 and its pressure nose 48 engages attaching element 1 of boot 2. When pressure nose 48 comes to rest on attaching element 1, at point 49 seen in FIG. 11, lock 41 pivots in the direction of the arrow 47 around the support point 49 and its profiled portion 44 moves out of contact with housing 42 as seen in FIG. 11. As a result, lock 41 itself is the journal which pivots in housing 42, or in other words, lock 41 is pivotally attached to support 43 by a virtual journal. In order to prevent lock 41 from pivoting beyond the position in which the lock ensures that the boot is held on the ski when element 1 of the boot is not engaged in lock 41, a shoulder 58 is provided on the lock to act as an abutment for upper part 59 of support element 3.

In various embodiments described above, springs 9 and 45 which comprise the force producing elements of the apparatus, are formed in a manner so as to be manually operable. However, it is within the scope of the invention, as illustrated in FIG. 12, to provide a different means for manually manipulating the apparatus of the present invention. This means in the embodiment illustrated in FIG. 12 is an upper portion 50 of lock 51. In this embodiment, spring 52 comprises as traction spring attached at one end 53 on support 54, and attached at its other end 55 to a support element 56. Support element 56 is adapted to be displaced on an activation zone 57 which is composed of a ramp on lock 51, which is longer than element 56. Lock 51 pivots in accordance with the mounting illustrated in FIG. 8.

FIGS. 13–15 illustrate another embodiment of the present invention which is different from that illustrated in FIGS. 9–11, particularly because of the difference in the journal as well as the spring. In this embodiment, lock 60 comprises a journal 61 received in a housing 62 on support 63. In FIG. 13 lock 60 is in its inactive, non-retention position for permitting the removal of the boot. In this position, journal 61 rests on one of the walls of housing 62 under the action of spring 64, whose activation point 140 has passed under equilibrium threshold 66. In FIG. 14, lock 60 has been displaced along the direction of arrow 65 up to an unstable, equilibrium position at threshold 66. Journal 61 is still resting against one of the walls of housing 62 in this position. By continuing to tilt lock 60 along the direction of arrow 65 seen in FIG. 15, lock 60 finally rests on element 1 of boot 2, and the direction 67 of the action of spring 64 on lock 60 passes beyond a support point 68 at which lock 60 is supported on element 1. As a result, lock 60 pivots in the direction of arrow 69 around support point 68, and its journal 61 moves out of contact with the walls of housing 62, thereby receiving no support from housing 62. In this embodiment, spring 64 comprises at least one elastically deformable coil 70 which is coiled in the direction of arrow 171 illustrated in FIG. 15.

Figure 16:
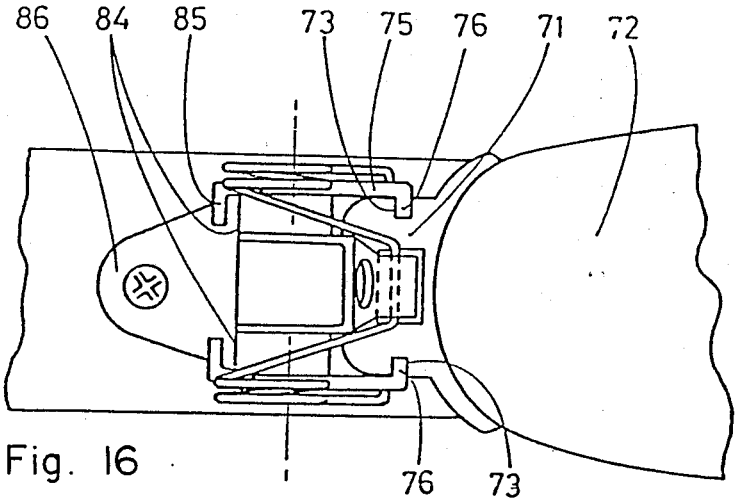
FIGS. 16 and 17 show, respectively, top and elevational views of another embodiment of the support element associated with the apparatus of the present invention.
Figure 17:
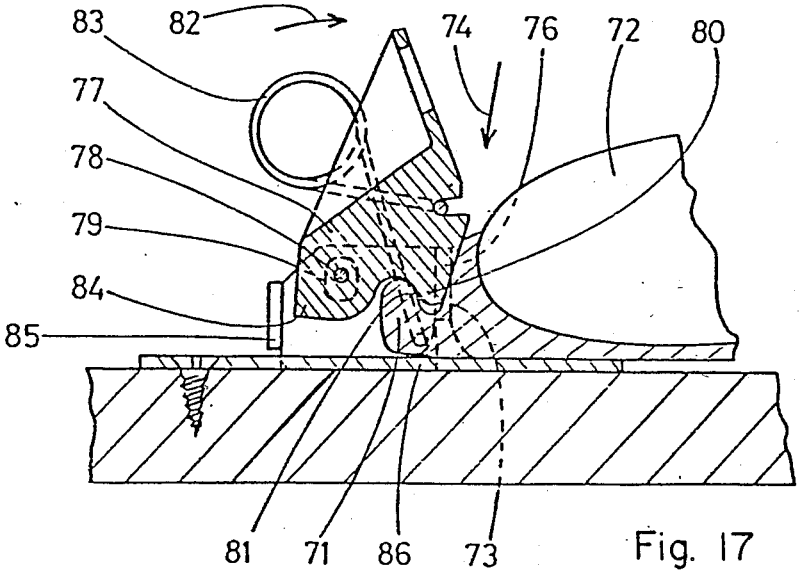

It is also within the scope of the present invention, as seen in FIGS. 16–17, for a support element 75 to be in the shape of a stirrup, whose wings 76 comprise tenons adapted to engage slits or mortises 73 of the attaching portion 71 of boot 72. This is accomplished by the downward displacement along direction of arrow 74 seen in FIG. 17, of attaching portion 71 into the tenons of wings 76. Lateral slits 73 have a shape complimentary to the tenons. In this embodiment lock 77 is pivotally mounted on a floating journal 78 which is positioned in a housing 79 in the same manner as the first embodiment illustrated in FIGS. 1–5. Further, locking of the boot on the ski is effected in the manner which is comparable to the preceding embodiments, with pressure nose 80 resting on a profiled portion 81 of attaching portion 71 of the boot. However, lock 77 has no stable, inactive, non-retention position for removing the boot. Thus, when attaching portion 71 of the boot is removed from the binding, lock 77 pivots along the direction of the arrow 82 under the bias of spring 83 so that its journal 78 comes to rest against the walls of housing 79, while its heel 84 contacts wings 85 and support 86.

Figure 18:
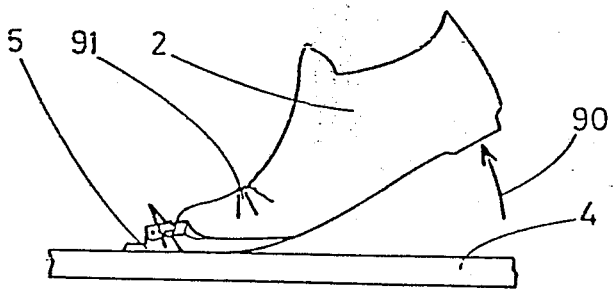

FIG. 18 illustrates a first embodiment for mounting of the apparatus of the present invention on a ski 4 by means of support 5 which is fixed and rigid with respect to the ski. In this embodiment the bottom surface of support 5 is rigidly fixed to the ski and is not displaced as the heel of the boot is lifted from the ski. The raising of the heel of boot 2 in the direction of arrow 90 is possible due to the flexibility of the boot in front metatarsal zone 91 of the boot.

Figure 19:
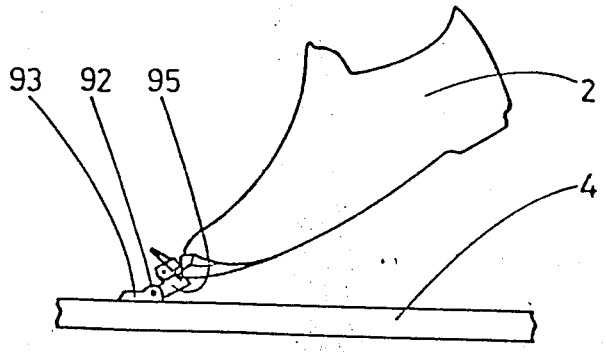
FIGS. 18, 19, and 20 illustrate schematic views of different modes of linking the apparatus of the present invention to the ski.
Figure 20:
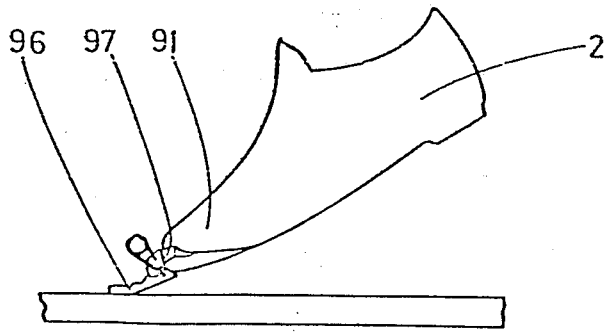

It is also within the scope of the invention to provide means for facilitating the lifting of the heel of the boot of the ski. For example, as illustrated in FIG. 19, support 95 is pivotally linked to ski 4 around a transverse journal 92 provided on base plate 93. This pivotable link between support 95 and a base plate 93 facilitates the raising of the heel as is illustrated in FIG. 19. In addition, it is also within the scope of the invention to subject the pivoting link between support 95 and base plate 93 to the action of an elastic element which biases boot 2 towards ski 4. In another embodiment, illustrated in FIG. 20, a support 96 facilitates raising of the heel of the boot in another manner. In this embodiment support 96 comprises a flexible zone positioned between one end fastened to the ski and its other end 97 which is fastened to the front portion 91 of boot 2. In addition, it is within the scope of the present invention to provide abutments for limiting the degree to which the heel of the boot is raised off the ski.

Although the present invention has been described with reference to particular means, methods and embodiments, it should be understood that the invention is not limited thereto but extends to all equivalents within the scope of the claims.

What is claimed is:

1. An apparatus for connecting one end of a boot to a ski, wherein said end of said boot has an attaching element, and wherein said apparatus comprises:

(a) a support element for engaging said attaching element of said boot;

(b) a support adapted to be positioned on an upper surface of said ski, said support element projecting from said support;

(c) a movable lock for cooperation with said support element and said attaching element for locking said boot to said ski, wherein said movable lock is adapted to pivot with respect to said ski between an inactive, non-retention position in which said boot is free to be connected to and removed from said ski, and an active, retention position in which said boot is locked on said ski;

(d) means for biasing said movable lock against displacement out of said active, retention position; and (e) means for pivotally connecting said movable lock on said support so as to permit said movable lock to be pivotally supported by a portion of said support in said inactive, non-retention position and during movement toward and away from said active, retention position, and for permitting said movable lock to be unsupported by said portion of said support in said active, retention position, wherein said means for pivotally connecting pivots about an axis and is spaced from said support in all directions about said axis in said active, retention position.

2. The apparatus defined by claim 1 wherein said boot comprises an end and an attaching element at said end of said boot, wherein said support element is adapted to engage one of the following: said end of said boot, and said attaching element at said one end of said boot; wherein said means for connecting pivotally attaches said movable lock to said ski around an axis transverse to said ski so that said movable lock is adapted to pivot around said transverse axis between said active, retention position and said inactive, non-retention position.

3. The apparatus defined by claim 2 further comprising a housing having walls, wherein said means for connecting is spaced from said walls of said housing when said movable lock is in said active, retention position, and wherein said means for biasing said movable lock against displacement out of said active, retention position comprises means for elastically biasing said movable lock against displacement out of said active, retention position.

4. The apparatus defined by claim 3 wherein lock comprises two wings, each comprising a mortise, wherein said support comprises two tenons, each adapted to be received in one of said mortises.

5. The apparatus defined by claim 3 wherein said means for connecting is fixed to said movable lock, wherein said housing is positioned in said support.

6. The apparatus defined by claim 3 wherein said support comprises an upper surface having a groove thereon, wherein said groove has a substantially semi-circular cross-section, wherein said movable lock comprises a portion having a substantially semi-circular cross-section which corresponds to said substantially semi-circular groove and which pivots in said groove, wherein said means for connecting comprises said movable lock, and wherein said housing comprises said groove.

7. The apparatus defined by claim 3 wherein said means for connecting contacts at least one of said walls of said housing in response to said movable lock being pivoted into said inactive, non-retention position.

8. The apparatus defined by claim 3 wherein said movable lock and said elastic biasing means comprise means for biasing said one end of said boot and said attaching element against said support element.

9. The apparatus defined by claim 3 wherein said elastic biasing means biases said lock against displacement out of said inactive, non-retention position.

10. The apparatus defined by claim 3 wherein said elastic biasing means comprises a spring pivotally mounted on said support between a first and a second position, wherein in said first position said spring biases said movable lock against displacement out of said active, retention position, and wherein in said second position said spring biases said movable lock against displacement out of said inactive, non-retention position.

11. The apparatus defined by claim 3 wherein said elastic biasing means is pivotally attached to said ski around an axis transverse to said ski, wherein said elastic biasing means biases said movable lock at an activation point on said movable lock, wherein said means for connecting, said elastic biasing means, and said movable lock together comprise a toggle system defined by the relative positions of said transverse axis around which said movable lock pivots, said transverse axis around which said elastic biasing means pivots, and said activation point.

12. The apparatus defined by claim 11 wherein said toggle system comprises means for biasing said movable lock into its active, retention position when said activation point is positioned on one side of a plane passing through said transverse pivot axis of said elastic biasing means and said transverse pivot axis of said movable lock, and wherein said toggle system comprises means for biasing said movable lock into its inactive, non-retention position when said activation point is positioned on the other side of said plane.

13. The apparatus defined by claim 11 wherein said activation point of said elastic biasing means on said movable lock is displaced in response to pivoting of said elastic biasing means around said transverse pivot axis of said elastic biasing means.

14. The apparatus defined by claim 13 wherein said toggle system comprises means for displacing said activation point into a plane passing through said transverse axis of said movable lock and said transverse axis of said elastic biasing means in response to pivoting of said movable lock away from its inactive, non-retention position to an unstable, intermediate position intermediate between said inactive, non-retention position and said active, retention position without relative movement of the activation point and said movable lock.

15. The apparatus defined by claim 14 wherein said activation point is displaced out of said plane with respect to said movable lock in response to pivoting of said movable lock from its intermediate position toward said active, retention position.

16. The apparatus defined by claim 15 wherein said support comprises lateral sides, wherein said elastic biasing means comprises a spring having two lateral portions and a median portion connecting said two lateral portions, wherein each lateral portion comprises an end, wherein said ends of said lateral portions of said spring are each pivotally connected on one of said lateral sides of said support, wherein said median portion of said spring contacts said movable lock at said activation point.

17. The apparatus defined by claim 11 further comprising first and second abutments for limiting the pivoting of said movable lock, wherein said first abutment defines said active, retention position of said movable lock, wherein said second abutment defines said inactive, non-retention position of said movable lock.

18. The apparatus defined by claim 17 wherein said movable lock is in its active, retention position when said moveable lock contacts said first abutment, wherein said movable lock is in its inactive, non-retention position when said movable lock contacts said second abutment.

19. The apparatus defined by claim 17 wherein said second abutment is positioned on one side of a plane passing through said transverse axis of said movable lock and said transverse axis of said elastic biasing means, and wherein said second abutment defines a stable, inactive, non-retention position of said movable lock.

20. The apparatus defined by claim 11 wherein said movable lock comprises a ramp, wherein said activation point is positioned on said ramp, and wherein said elastic biasing means engages said ramp at said activation point.

21. The apparatus defined by claim 20 wherein said ramp comprises first and second abutments, wherein said elastic biasing means contacts said first ramp abutment in response to pivoting of said movable lock into said active, retention position and wherein said elastic biasing mean contacts said second ramp abutment in response to pivoting of said movable lock into said inactive, non-retention position.

22. The apparatus defined by claim 21 wherein said ramp comprises two ends, wherein said first and second ramp abutments are each positioned at a different end of said ramp, wherein said first and second ramp abutments each prevent movement of said elastic biasing means in a different direction when said elastic biasing means contacts said first and second ramp abutments.

23. The apparatus defined by claim 20 wherein said ramp comprises a retention notch for retaining said elastic biasing means therein, wherein said retention notch comprises said activation point of said elastic biasing means on said movable lock when said lock is in said active, retention position, wherein said apparatus comprises means for positioning said movable lock in a stable, active, retention position and means for positioning said movable lock in a stable, inactive, retention position.

24. The apparatus defined by claim 3 wherein said movable lock further comprises a lower ridge comprising a pedal adapted to cooperate with at least one of the following during the attaching of said boot to said ski: said boot and said attaching element of said boot.

25. The apparatus defined by claim 24 wherein apparatus further comprises means for pivoting said movable lock from said inactive, non-retention position to said active, retention position in response to downward pressure from one of said boot and said attaching element of said boot on said pedal, whereby said apparatus comprises means for automatically attaching said boot on said ski.

26. The apparatus defined by claim 3 wherein said movable lock further comprises a pressure nose adapted to contact said support element when said movable lock is in said active, retention position.

27. The apparatus defined by claim 26 wherein said attaching element comprises a transverse bit having two lateral arms and a transverse arm connecting said two lateral arms, wherein said transverse arm comprises a rear side having a support point thereon, wherein said pressure nose comprises a front side and a rear side, wherein said apparatus further comprises means for engaging said front side of said pressure nose with said rear side and said support point of said transverse arm as said movable lock pivots into said active, retention position.

28. The apparatus defined by claim 27 wherein said apparatus further comprises means for engaging said means for connecting with said walls when said movable lock is in said inactive, non-retention position, wherein said apparatus further comprises means for displacing said means for connecting out of contact with said walls before said movable lock pivots into said active, retention position, wherein said apparatus further comprises means for engaging said front side of said pressure nose with said support point of said transverse arm before said movable lock pivots into said active, retention position, wherein said apparatus further comprises means for pivoting said movable lock on said support point as said means for connecting is displaced out of contact with said walls of said housing.

29. The apparatus defined by claim 26 wherein said pressure nose is adapted to engage said attaching element and said support element.

30. The apparatus defined by claim 29 wherein said pressure nose engages said attaching element and said support element in response to pivoting of said movable lock into said active, retention position.

31. The apparatus defined by claim 26 wherein said pressure nose comprises first and second transversely extending sides, wherein said first side of said pressure nose engages said support in response to pivoting of said movable lock into said active, retention position, wherein said second side of said pressure nose engages said attaching element in response to pivoting of said movable lock into, said active, retention position.

32. The apparatus defined by claim 31 wherein said pressure nose is substantially V-shaped when viewed in a direction transverse to said ski, wherein said pressure nose extends transversely to said ski.

33. The apparatus defined by claim 3 in combination with said attaching element.

34. The apparatus defined by claim 26 wherein the force exerted on said movable lock by said elastic biasing means is along a direction passing through said pressure nose.

35. The apparatus defined by claim 26 wherein said boot comprises a support zone, wherein said support element comprises a first side facing said boot and a second side opposite from said first side, wherein said second side comprises a median portion, wherein said support element extends vertically above said ski, wherein said first side of said support element comprises an abutment zone adapted to engage said support zone of said boot when said movable lock is in said active, retention position, wherein said second side of said support element comprises a boss positioned in said median portion of said second side, wherein said pressure nose comprises a groove, corresponding in shape to said boss, wherein said groove of said pressure nose is adapted to engage said boss when said movable lock is in said active, retention position.

36. The apparatus defined by claim 35 wherein said boss is positioned on said second side at substantially the height of said pressure nose when said movable lock is in said inactive, non-retention position, wherein said boot is connected to said ski by raising said boot above said apparatus, lowering said boot so that said attaching element of said boot slides down said second side of said support element and then slides over said boss, thereby forcing said boot forward toward said abutment zone of said support element, containing to displace said attaching element downwards until said attaching element contacts said pressure nose, pressing said pressure nose downward with said attaching element, thereby rotating said movable lock from said inactive, non-retention position toward said active, retention position.

37. The apparatus defined by claim 3 wherein said elastic biasing means comprises a spring having two lateral arms, each of which is connected to said support, and a median portion connecting said two lateral arms, wherein said median portion is adapted to be displaced on said movable lock, wherein said elastic biasing means is pivotally connected to said ski at said two lateral arms around an axis transverse to said ski, wherein said elastic biasing means biases said movable lock at an activation point on said movable lock, wherein said means for connecting said elastic biasing means, and said movable lock together comprise a toggle system defined by the relative positions of said transverse axis around which said movable lock pivots, said transverse axis around which said elastic biasing means pivots, and said activation point, wherein said elastic biasing means comprises means for displacing said movable lock from said active, retention position to said inactive, non-retention position and from said inactive, non-retention position to said active, retention position by pivoting said median portion of said elastic biasing means across a plane passing through said transverse axis of said movable lock and said transverse axis of said elastic biasing means.

38. The apparatus defined by claim 3 wherein said movable lock comprises a surface, wherein said elastic biasing means is adapted-to pivot on said ski around a transverse axis, wherein said elastic biasing means comprises a median portion adapted to slide on said surface of said movable lock in response to pivoting of said elastic biasing means, wherein said movable lock further comprises an abutment for limiting the displacement of said median portion of said elastic biasing means on said surface of said movable lock, wherein said abutment is positioned in front of a plane passing through said transverse axes of said movable lock and said elastic biasing means, wherein said apparatus further comprises means for changing the position of said abutment.

39. The apparatus defined by claim 3 wherein said elastic biasing means comprises a stirrup comprising a metallic, elastic deformable wire having two ends and a median portion between said two ends, wherein said two ends define a pivoting axis around which said wire is adapted to pivot, wherein said two ends are elastically connected to said median portion.

40. The apparatus defined by claim 39 wherein said wire comprises a lever comprising means for manually removing said boot from said ski when said boot is held on said ski by said movable lock.

41. The apparatus defined by claim 3 wherein said movable lock further comprises a ramp and a movable element adapted to be displaced on said ramp, wherein said elastic biasing means comprises a traction spring having first and second ends, wherein said first end is attached to said support, wherein said second end is connected to said movable element.

42. The apparatus defined by claim 41 wherein said support is connected to said ski and comprises an upper surface having a groove thereon, wherein said groove has a substantially semi-circular cross-section, wherein said movable lock comprises a portion having a substantially semi-circular cross-section which corresponds to said semi-circular groove and which-pivots in said groove, wherein said means for connecting comprises said movable lock, wherein said housing comprises said groove.

43. The apparatus defined by claim 3 wherein said movable lock contacts said attaching element at a point of contact when said movable lock is in said active, retention position, wherein said apparatus further comprises means for applying the force of said elastic biasing means on said movable lock behind said point of contact between said attaching element and said movable lock when said movable lock is in said active, retention position.

44. The apparatus defined by claim 3 wherein said support is connected to said ski and comprises an upper surface having a groove thereon and an opening therein comprising said housing, wherein said groove has a substantially semi-circular cross-section, wherein said movable lock comprises a portion having a substantially semi-circular cross-section which corresponds to said substantially semi-circular groove and which engages said groove as said movable lock pivots around said means for connecting.

45. The apparatus defined by claim 3 wherein said elastic biasing means comprises an elastically deformable element having two lateral arms each connected to said support and a median portion between said two lateral arms, wherein said median portion comprises an elastically deformable coil extending above said movable lock.

46. The apparatus defined by claim 1 wherein said means for pivotally connecting said movable lock on said support comprises a journal and means for enabling said journal to be unsupported when said movable lock is in said active, retention position.

47. The apparatus defined by claim 3 wherein said support is connected to said ski, wherein said support comprises a stirrup having two lateral wings, each of which comprises a tenon, wherein said means for connecting comprises two spaced apart lateral mortises, wherein said boot is connected to said ski by raising said boot above said ski and over said lateral wings, and displacing said boot downward so that each tenon engages one of said mortises.

48. The apparatus defined by claim 47 wherein said movable lock further comprises a pressure nose at the rear end thereof, wherein said attaching element comprises a front portion having a profile complementary to the shape of said pressure nose so that said pressure nose engages said profile when said movable lock is in said active, retention position, wherein said apparatus further comprises means for producing a stable, active, retention position for said movable lock and for producing an unstable, inactive, non-retention position for said movable lock.

49. The apparatus defined by claim 3 wherein said boot comprises a heel, wherein said apparatus comprises a cross-country ski binding for connecting the front of said boot to said ski, whereby said heel of said boot is permitted to be lifted off said ski.

50. The apparatus defined by claim 49 wherein said support is rigidly affixed to said ski, wherein said support comprises a bottom surface connecting to said ski, wherein the entire bottom surface of said support remains rigidly affixed to said ski in response to lifting of said heel of said boot upward.

51. The apparatus defined by claim 49 further comprising a base plate, rigidly attached to said ski, wherein said support is pivotally connected to said base plate around an axis transverse to said ski, whereby-lifting of said heel of said boot pivots said support upwardly around said transverse axis of said base plate.

52. The apparatus defined by claim 51 further comprising means for pivotally linking said base plate and said support, wherein said linking means comprises means for elastically biasing said boot downwardly toward said ski.

53. The apparatus defined by claim 49 wherein said support comprises a first portion rigidly connected to said ski and a second portion attached to said boot, wherein said support is flexible between said first and second portions, whereby lifting of said heel of said boot above said ski flexes and lifts a portion of said support above said ski.

54. The apparatus defined by claim 29 wherein said boot comprises a front end, wherein said support element, said attaching element, and said pressure nose comprise a front and a rear surface, wherein said apparatus comprises means for:

biasing said front end of said boot against said rear surface of said support element, biasing said rear surface of said pressure nose against said front surface of said support element, and biasing said front surface of said pressure nose against said rear surface of said attaching element, all in response to pivoting of said movable lock into said active, retention position.

55. An apparatus for connecting one end of a boot to a ski, wherein said apparatus comprises: (a) a support element for engaging a portion of said end of said boot;

(b) a support adapted to be positioned on an upper surface of said ski, said support element projecting from said support;

(c) a movable lock for cooperation with said support element and said portion of said end of said boot for locking said boot to said ski, wherein said movable lock is pivotable with respect to said ski between an inactive, non-retention position in which said boot is free to be connected to and removed from said ski, and an active, retention position in which said boot is locked on said ski, wherein said movable lock further comprises a housing having walls;

(d) means for biasing said movable lock against displacement out of said active, retention position; and (c) a journal for pivotally connecting said movable lock on said support around an axis transverse to said ski so as to permit said movable lock to be pivotally supported by a portion of said support via said journal in said inactive, non-retention position and as said movable lock pivots toward and away from said active, retention position, wherein said journal is adapted to be spaced from said walls of said housing in all directions about said axis when said movable lock is in said active, retention position, permitting said movable lock to be unsupported by said portion of said support in said active, retention position.

56. An apparatus for connecting one end of a boot to a ski, wherein said end of said boot has an attaching element, and wherein said apparatus comprises:

(a) a support element for engaging said attaching element of said boot;

(b) a support adapted to be attached to said ski, said support element attached to said support;

(c) a movable lock for cooperation with said support element and said attaching element for locking said boot on said ski, wherein said movable lock is adapted to pivot with respect to said ski between an inactive, non-retention position in which said boot is free to be connected to and removed from said ski, and an active, retention position in which said boot is locked on said ski;

(d) means for biasing said movable lock against displacement out of said active, retention position; and (e) means for pivotally connecting said movable lock on said support so as to permit said movable lock to be pivotally supported by a portion of said support in said inactive, non-retention position and during movement toward and away from said active, retention position, and for permitting said movable lock to be unsupported by said portion of said support in said active, retention position, wherein said means for pivotally connecting pivots about about an axis and is spaced from said support in all directions about said axis in said active, retention position, and wherein said movable lock is maintained in said active, retention position by (1) said means for biasing said movable lock against displacement out of said active, retention position; (2) said support element; and (3) said attaching element of said boot.

* * * * *

UNITED STATES PATENT AND TRADEMARK OFFICE

CERTIFICATE OF CORRECTION

PATENT NO. : 4,907,816

DATED : March 13, 1990

INVENTOR(S) : J. DUNAND et al.

It is certified that error appears in the above-identified patent and that said Letters Patent is hereby corrected as shown below:

On the title page change "Paul Arnult" to ---Paul Arnulf---;
Column 1, line 14, change "4.496,168" to ---4,496,169---;
Column 1, line 47, change "Of" to ---of---;
Column 2, line 22, insert ---to--- after "lock";
Column 2, line 23, insert ---lock--- after "movable";
Column 3, line 10, insert ---.--- after "position";
Column 3, line 14, insert ---the--- after "biases";
Column 3, line 29, insert ---the--- after "when";
Column 3, line 63, inset ---the--- after "defines";
Column 5, line 14, insert ---.--- after "sides";
Column 5, line 17, insert ---.--- after "position";
Column 6, line 40, delete "substantially" (second occurrence):
Column 7, line 42, change "." to ---,--- after "embodiment";
Column 8, line 25, change "position" to ---positions---;
Column 9, line 32, change "VIII" to ---VII---;
Column 9, line 45, change "inventions" to ---invention---;
Column 10, line 27, change "position" to ---portion---;
Column 11, lines 30/31, insert ---position--- after "non-retention---;
Column 11, line 40, change "a" to ---an---;
Column 13, line 13, insert ---in--- after "illustrated";
Column 13, line 26, change "7 and 8" to ---7a and 8a---;
Column 17, line 49 (claim 21, line 6), change "mean" to ---means---;
Column 18, line 54 (claim 31, line 4), insert ---element--- after "support";
Column 18, line 58 (claim 31, line 8), delete "," after "into";
Column 19, line 26 (claim 36, line 10), change "containing" to ---continuing---;
Column 20, line 25 (claim 42, line 7), change "which-pivots" to ---which pivots---;
Column 21, line 24 (claim 51, line 2), change "attached" to ---connected---;

UNITED STATES PATENT AND TRADEMARK OFFICE

CERTIFICATE OF CORRECTION

PATENT NO. : 4,907,816

DATED : March 13, 1990

INVENTOR(S) : J. DUNAND et al.

It is certified that error appears in the above-identified patent and that said Letters Patent is hereby corrected as shown below:

Column 21, line 26 (claim 51, line 4), change "whereby-lifting" to ---whereby lifting---;

Column 22, line 12 (claim 55, line 18) change "(c)" to ---(3)---; and

Column 22, line 50 (claim 56, line 26), change "about about" to ---about---.

Signed and Sealed this

Thirteenth Day of October, 1992

*Attest:*

DOUGLAS B. COMER

*Attesting Officer*

*Acting Commissioner of Patents and Trademarks*